US005080862A

United States Patent [19]

Luthra

[11] Patent Number: 5,080,862

[45] Date of Patent: Jan. 14, 1992

[54] IRIDIUM SILICON ALLOY

[75] Inventor: Krishan L. Luthra, Schenectady, N.Y.

[73] Assignee: General Electric Company, Schenectady, N.Y.

[21] Appl. No.: 514,463

[22] Filed: Apr. 25, 1990

[51] Int. Cl.[5] ..... C22C 27/00

[52] U.S. Cl. ..... 420/461; 420/578; 420/580

[58] Field of Search ..... 420/461, 578, 580; 148/400, 430

[56] References Cited

PUBLICATIONS

Chem. Abs. 104(14): 120705w, 1986.

Metal Alloy Index (Metadex) 83(7): 33-1529, 1983.

*Primary Examiner*—R. Dean

*Assistant Examiner*—Margery S. Phipps

*Attorney, Agent, or Firm*—Paul E. Rochford; James C. Davis, Jr.; James Magee, Jr.

[57] ABSTRACT

An alloy having a very high resistance to oxidation is taught. The alloy contains between 30 and 75 atom percent of silicon in an iridium base. The alloy may be used in the form of a surface coating to protect structural elements of other materials from oxidation. The alloy may also be used as an ingredient of a composite.

2 Claims, 1 Drawing Sheet

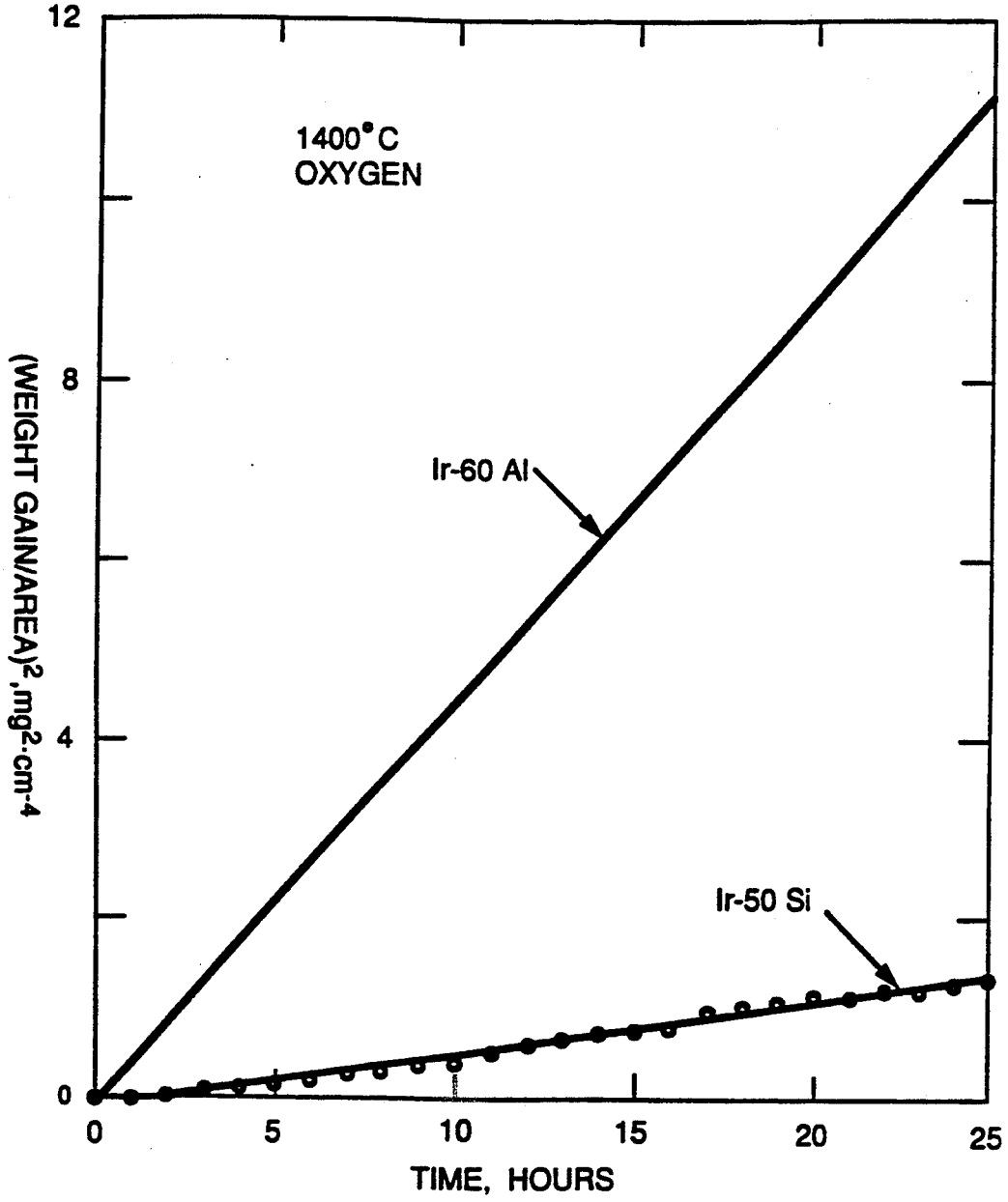
1400°C
OXYGEN
Ir-60 Al
Ir-50 Si
(WEIGHT GAIN/AREA)$^2$,mg$^2$·cm$^{-4}$
TIME, HOURS
0
4
8
12
0
5
10
15
20
25

IRIDIUM SILICON ALLOY

BACKGROUND OF THE INVENTION

The present invention relates to alloys of iridium and silicon, as well as to alloys of ruthenium and silicon, and to structures bearing coatings of such alloys. More particularly, the present invention relates to compositions of iridium and/or ruthenium, and silicon which resist oxidation at elevated temperatures and to structures suitable for use at higher temperatures which are, at least in part, protected from oxidation by having surface coatings of alloys of iridium and/or ruthenium, and silicon.

It is known that there are many alloys which have desirable sets of properties, particularly combinations of properties which render them suitable for use as structural elements. However, the use of alloys at higher temperatures results not only in the change in the properties which the alloy exhibits but also results in a tendency toward oxidation of the alloy at its surface. If the oxidation is of a character which continues then the structural element itself can fail because of the conversion of the metal of the structure to oxide or other product resulting from oxidation. Most irons and steels are notorious for the oxide or rust coating which forms on the surface thereof and extensive coating or painting is required to preserve the surface free of rust.

Other alloys or alloy systems also are highly subject to oxidation and oxidation rates have been measured by heating a sample of an alloy over a period of time and measuring the weight gain of the sample, as an adhesive oxide is formed at the surface, or a weight loss occurs because of a scaling of oxide at the surface together with a flaking of the oxide scale from the surface. Novel and unique properties are possible in a number of structural elements if the elements could be protected from the results of oxidation or other oxidative reaction. For example, carbon fiber composites have uniquely high strength and other valuable properties but such structures are subject to oxidation to form gaseous carbon monoxide or carbon dioxide. A great variety of proposals have been made for protecting structural elements including carbon fiber composites from oxidation for various periods of time during which the structure can be employed in carrying out its intended function.

BRIEF STATEMENT OF THE INVENTION

Accordingly, it is one object of the present invention to provide an alloy composition which has a desirable set of properties and which also has a relatively low level of oxidation rate.

Another object is to provide a structural element coated with an alloy having a low oxidation rate. Another object is to provide an alloy suitable for use at elevated temperatures without deterioration due to oxidation.

Another object is to provide an alloy which has the capability of forming a surface oxide which is protective and which has a very low rate of growth.

Other objects will be, in part, apparent and, in part, pointed out in the description which follows.

In one of its broader aspects, objects of the present invention can be achieved by providing an alloy of iridium and silicon containing between 30 and 75 atom percent silicon.

In another of its broader aspects, objects of the present invention can be achieved by providing an alloy of ruthenium and silicon containing between 30 and 75 atom percent silicon.

Pursuant to the present invention, combinations of iridium and ruthenium in all ratios may be formed into silicides containing between 30 and 75 atom percent silicon.

Other objects of the present invention can be achieved by providing a structural member and providing a protective coating of an alloy of iridium and/or ruthenium, and silicon to protect the structural element from attack by oxidative environment.

BRIEF DESCRIPTION OF THE DRAWING

The description of the present invention which follows will be understood with greater clarity if reference is made to the accompanying drawing in which the square of the ratio of weight gain to area of a specimen is plotted against the time in hours of exposure of the specimen to high temperature oxidation environment.

DETAILED DESCRIPTION OF THE INVENTION

Surprisingly, I have found that an alloy of iridium and silicon has a much lower rate of oxidation than I would have suspected.

It is known that an alloy of iridium containing 60 atom percent of aluminum has a desirably low rate of oxidation. The alloy of iridium with 60 atom percent of aluminum is believed to be the subject of a patent of Professor W. L. Worrell, of the University of Pennsylvania, although the applicant is not aware of the identification of patent by number. The alloy of iridium and aluminum has been recognized and designated as an alloy with an extremely low rate of oxidation and has been acclaimed for this combination of properties.

It was, therefore, somewhat surprising to find that a composition of iridium containing 50 atom percent silicon had an oxidation rate which was substantially power than that of the iridium alloy containing 60 atom percent aluminum.

In order to make a comparison between the known value for the oxidation rate for the iridium with 60 atom percent aluminum composition relative to an iridium silicon composition, the known data for the alloy of iridium and 60 atom percent of aluminum was plotted and a plot of this data appears in the accompanying figure. In this figure, the weight gain is presented as a combination of weight gain divided by area and this value is squared. The weight gain values are plotted as the ordinate in the graph of the figure. The time in hours is plotted as the abscissa.

An experiment was run employing a sample of an alloy of iridium containing 50 atom percent silicon and the data from this test is plotted in the figure together with the data obtained by Professor W.L. Worrell on the oxidation rate for the iridium 60 atom percent aluminum composition.

With reference now to the figure, it is evident that the oxidation rate for the iridium 50 atom percent silicon composition is far, far smaller than that for the iridium 60 atom percent aluminum composition. The actual weight gain as this gain is plotted in the figure is about 11.3 for the iridium aluminum alloy and about 1.3 for the iridium silicon alloy as identified in the figure. Obviously, from the data plotted in the figure, it is evident that very substantial improvement in oxidation resistance, in fact a greater than eight-fold improvement, exists for the iridium silicon alloy as compared to the iridium aluminum alloy.

The testing of the iridium silicon alloy was carried out in a mechanism which maintained the coupon sample of the alloy metal heated to about 1400C in an atmosphere of oxygen during the entire 25 hour test period. During the 25 hours, the sample was continuously weighed as it hung by a platinum wire from a weighing mechanism. The data points for the hourly weight measurements appear in the figure.

The actual alloy tested experimentally, the data for which is plotted in the figure, contained 50 atomic percent silicon and 50 atomic percent iridium. However, based on this test, it is concluded that compositions containing from 30 to 75 atom percent silicon in iridium have superior oxidation resistance properties relative to prior art alloy systems. Further, alloys containing from 40 to 70 atom percent silicon are deemed to have still greater oxidation resistance.

The composition containing between 45 atom percent and 55 atom percent silicon is a preferred composition and the composition containing 50 atom percent silicon is the test composition as reported in the figure.

As used herein, the phrase balance essentially iridium is used to designate a composition which may contain impurities normally associated with the ingredients of the alloy in minor percentages and also a composition which may contain minor additives which do not detract from the beneficial properties of the alloy.

When the alloys of this invention are exposed to oxygen at elevated temperature, a surface layer of silicon oxide is formed. Elements known to improve the adhesion of oxide scales such as metals selected from the group consisting of zirconium, titanium, hafnium, yttrium, scandium, lanthanum, and other rare earth elements can be present up to about 2 weight percent, or more preferably up to about 0.5 weight percent, in the alloys of silicon with iridium and/or ruthenium.

Regarding next the silicides of ruthenium, based on the accompanying experimental data obtained with respect to iridium and based on the essential properties and attributes of other noble metals, it is deemed that ruthenium forms a silicide similar to that of iridium both with respect to its oxidation resistance and with respect to its high melting point. The compositions of the present invention are deemed to be suitable for use at high temperatures above approximately 1000 degrees Centigrade and approaching 1800 to 2000 degrees Centigrade.

Ruthenium may be substituted for iridium in the silicide alloys of the present invention in all proportions including a 100% substitution. The silicon should preferably be present is such compositions to the extent of 30 to 75 percent as noted above. Also, the preferred compositions should contain between 40 and 70 atom percent silicon and the still more preferred compositions contain 45 to 55 atom percent of silicon. Such silicides of iridium and/or ruthenium form a very stable oxide layer on their surface which layer is essentially silicon oxide. The inclusion of small amounts of yttrium, hafnium, or zirconium or some combination of these elements, in concentrations less than 2 weight percent and preferably less than one half weight percent can have the desirable effect of enhancing the adhesion of the silicon oxide layer to the surface of the alloy and in this way can further enhance the oxidation resistance of the alloy. As noted above, a broader group of elements known to improve the adhesion of oxide scales to a metal substrate may be used in concentrations up to about 0.5 weight percent or more up to about 2 weight percent.

What is claimed is:

1. The alloy consisting essentially of approximately 30 to 75 atom percent silicon, said alloy containing in addition an effective amount less than 2 weight percent of at least one metal selected from the group consisting of yttrium, hafnium, and zirconium and the remainder essentially iridium.

2. The alloy consisting essentially of approximately 30 to 75 atom percent silicon, and containing in addition an effective amount less than 0.5 weight percent of at least one metal selected from the group consisting of yttrium, hafnium, and zirconium and the remainder essentially iridium.

* * * * *